US007260971B2

(12) United States Patent
Cappeller et al.

(10) Patent No.: US 7,260,971 B2
(45) Date of Patent: Aug. 28, 2007

(54) APPARATUS FOR LOCKING A SHEET OF METAL SUITABLE TO BE SHAPED IN A PRESS

(75) Inventors: Augusto Cappeller, Bassano del Grappa (IT); Massimo Fiorese, Bassano del Grappa (IT); Daniel Fantinato, Bassano del Grappa (IT)

(73) Assignee: Special Springs S.R.L., Rosa' (IT)

( * ) Notice: Subject to any disclaimer, the term of this patent is extended or adjusted under 35 U.S.C. 154(b) by 0 days.

(21) Appl. No.: 11/414,304

(22) Filed: May 1, 2006

(65) Prior Publication Data

US 2006/0260379 A1 Nov. 23, 2006

(30) Foreign Application Priority Data

May 17, 2005 (IT) ..... PD2005A0138

(51) Int. Cl.
*B21D 24/14* (2006.01)

(52) U.S. Cl. ..... 72/351; 72/453.13; 72/250; 100/259; 267/214; 267/219

(58) Field of Classification Search ..... 72/20.2, 72/350, 351, 453.13; 267/214, 219; 100/259
See application file for complete search history.

(56) References Cited

U.S. PATENT DOCUMENTS 2,918,272 A * 12/1959 Williamson ..... 267/119
3,653,301 A * 4/1972 Clendenin et al. ..... 92/62
4,233,872 A * 11/1980 Schulze ..... 83/617
4,635,466 A * 1/1987 Seki et al. ..... 72/453.13
5,076,404 A * 12/1991 Gustafsson ..... 188/314
5,435,530 A * 7/1995 Sand ..... 267/114
5,499,525 A 3/1996 Kordak et al.
5,588,641 A * 12/1996 Sand ..... 267/119

FOREIGN PATENT DOCUMENTS

EP 0 406 792 A 1/1991
EP 0 424 122 A 4/1991
EP 1387088 A1 * 2/2004
JP 2000071024 A * 3/2000

OTHER PUBLICATIONS

Patent Abstracts of Japan vol. 2000 No. 06, Sep. 22, 2000 & JP 2000 071024 A (Nissan Motor Co Ltd), Mar. 7, 2000 *abstract*.

* cited by examiner

*Primary Examiner*—Dmitry Suhol
(74) *Attorney, Agent, or Firm*—Modiano & Associati; Albert Josif; Daniel J. O'Byrne

(57) ABSTRACT

An apparatus for locking a sheet of metal to be shaped in a press, comprising at least one fluid-operated actuator for translational motion of a first sheet presser, adapted to support, in an initial operation step a sheet of metal to be shaped, arranged above a first lower die part, coupled to the base of the press. The first presser cooperates with a second presser, coupled to the second die part associated with the upper ram of the press, in locking a perimetric portion of the sheet of metal during shaping. The actuators are part of a circuit for regenerating and supplying the working fluid, provided with devices for the delayed return of the actuators, upon opening the press, for shaped sheet protection.

10 Claims, 2 Drawing Sheets

APPARATUS FOR LOCKING A SHEET OF METAL SUITABLE TO BE SHAPED IN A PRESS

The present invention relates to an apparatus for locking a sheet of metal suitable to be shaped in a press.

BACKGROUND OF THE INVENTION

Apparatuses for locking the sheet of metal to be shaped are currently used in presses for cold-forming operations, such as pressing and drawing metal sheets.

The sheet of metal must in fact be locked in several points of one of its perimetric portions in order to prevent regions arranged perimetrically with respect to the area to be shaped of the sheet from being moved inappropriately between the die parts, jeopardizing the obtainment of the intended shaping.

Currently known apparatuses generally comprise at least one fluid-operated (gas-operated or hydraulic) actuator for the translational motion of a first sheet presser, which is adapted to support, during an initial step of a shaping operation, the sheet of metal to be shaped.

These fluid-operated actuators are generally constituted by gas cylinder actuators.

The first lower sheet presser supports the metal sheet to be shaped so that it lies above a first lower die part, which is rigidly coupled to the base of the press.

Such first sheet presser is adapted to cooperate with a second sheet presser, which is instead rigidly coupled to the second die part associated with the upper slider of the press.

During the actual shaping operation, i.e., during the descent of the upper ram of the press, the two sheet pressers hold a perimetric portion of the metal sheet closed between them.

The gas cylinder actuators which support the lower sheet presser are part of a circuit for regenerating and supplying the working fluid, i.e., the gas, which is provided with suitable means for the delayed return of the pistons, during the opening of the press.

When the piston of the gas cylinder actuator is pushed downward by the action of the press, the gas, which is intrinsically compressible, is in fact evacuated only partially from the pressurized chamber of the actuator; at the beginning of the step for extraction of the shaped sheet from the press, when the upper ram moves upward again and the actuators are discharged, the compressed gas, which is still present within the chamber of each actuator, expands, acting with a substantially impulsive thrust on the perimetric portions of the freshly stamped metal sheet, causing warping, inflections or other similar deformations thereof or even pushing the entire sheet so that it collides against the upper die part, which has started to rise, causing damage.

Such means for the delayed return of the pistons of the gas cylinder actuators are constituted generally by hydraulic plenums or mixed oil and gas plenums, which are adapted to send pressurized oil, under the thrust of the upper ram of the press, into the gas cylinder actuator, in the cylinder compartment which lies opposite the one in which the gas acts, with respect to the piston.

These means, in addition to being expensive, do not eliminate the problem of the overheating of the gas which flows through the intake and discharge valves, said overheating producing an increase in the pressure that the gas applies within the cylinder of the actuator.

Hydraulic plenums also must be provided with cooling devices, since oil, too, by overheating, changes its properties.

In order to eliminate the drawbacks caused by gas overheating, it is necessary to apply cooling devices which are onerous both in terms of additional costs and in terms of space occupation.

Further, the simple application of the hydraulic plenums is not sufficient to eliminate completely the so-called "spring-back" effect, i.e., the elastic reaction of the compressed gas that has remained in the actuator at the end of the compression of said actuator.

It is in fact necessary to coordinate the operation of the plenum or plenums and of the press so as to anticipate the blocking of the injection of oil into the actuator and avoid even the slightest return of oil into the plenum if the thrust of the gas is simultaneous with, or, worse still, anticipates the closure of the one-way valve.

SUMMARY OF THE INVENTION

The aim of the present invention is to provide an apparatus for locking a sheet of metal suitable to be shaped in a press which can obviate the drawbacks noted by known types of apparatus.

Within this aim, an object of the present invention is to provide an apparatus which can maintain the retention of the lower sheet presser when the press stops applying its thrust and the upper die is lifted.

Another object of the present invention is to provide an apparatus which is simpler and cheaper than known apparatuses and can be applied easily to presses which are already known and in use.

Another object of the present invention is to provide an apparatus in which the temperature of the fluid used therein can be controlled easily.

A further object of the present invention is to provide an apparatus in which the contrast force of the fluid-operated actuators on the lower sheet presser is adjustable.

A still further object of the present invention is to provide an apparatus for locking a sheet of metal suitable to be shaped in a press which can be manufactured cheaply with known systems and technologies.

This aim and these and other objects, which will become better apparent hereinafter, are achieved by an apparatus for locking a sheet of metal suitable to be shaped in a press, of the type which comprises at least one fluid-operated actuator for the vertical translational motion of a first sheet presser, which is adapted to support, in an initial step of an operation for shaping by pressing, drawing or the like, a sheet of metal to be shaped, which is arranged above a first lower die part, which is rigidly coupled to the base of the press, said first presser being suitable to cooperate with a second presser, which is rigidly coupled to the second die part associated with the upper ram of the press, in locking a perimetric portion of the sheet of metal during said shaping operation, said at least one actuator being part of a circuit for regenerating and supplying the working fluid, provided with means for the delayed return of the at least one actuator, in the step for opening the press, in order to protect the integrity of the shaped sheet, said apparatus being characterized in that said at least one actuator is constituted by a hydraulic cylinder and said working fluid is a hydraulic liquid such as oil or equivalent.

BRIEF DESCRIPTION OF THE DRAWINGS

Further characteristics and advantages of the invention will become better apparent from the following detailed description of a preferred but not exclusive embodiment thereof, illustrated by way of non-limiting example in the accompanying drawings, wherein.

DESCRIPTION OF THE PREFERRED EMBODIMENTS

Figure 1:
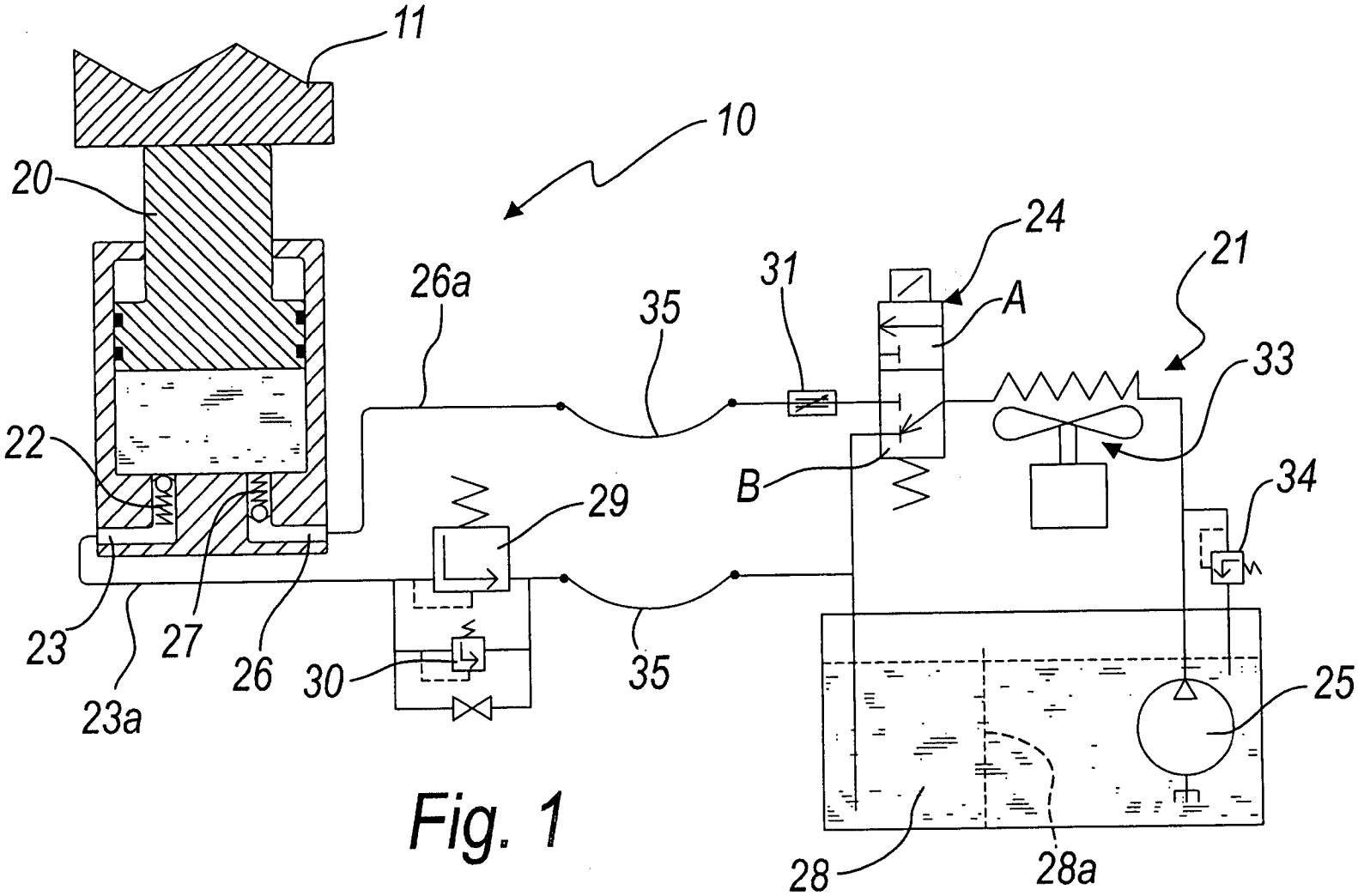
FIG. 1 is a schematic view of an apparatus according to the invention.

With reference to the figures, an apparatus for locking a sheet of metal suitable to be shaped in a press according to the invention is generally designated by the reference numeral 10.

The apparatus 10 comprises, in the schematic embodiment described here, two fluid-operated actuators 20 for the vertical translational motion of a first sheet presser 11.

Figure 2:
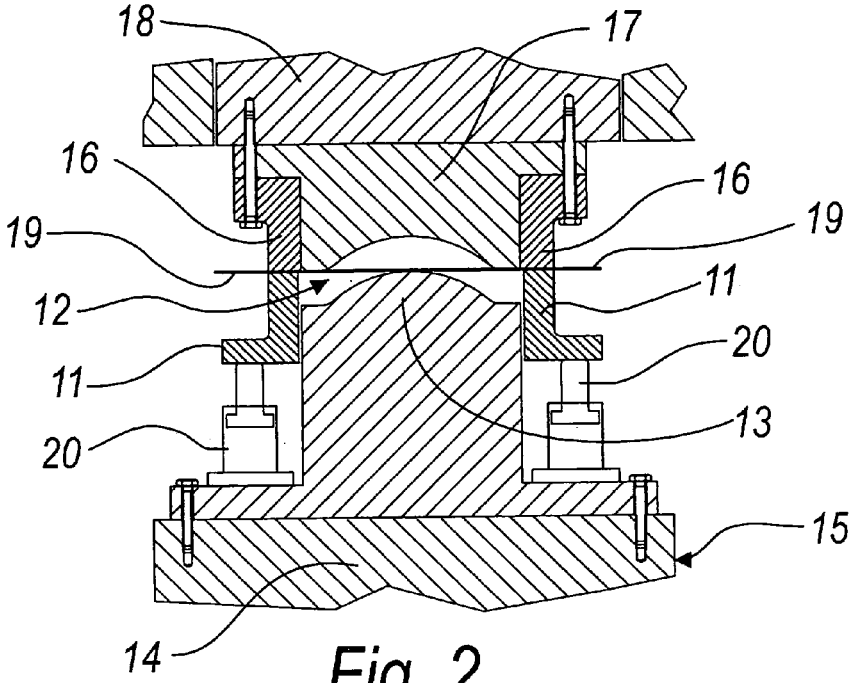
FIG. 2 is a sectional view of a first step of the operation of a press to which an apparatus according to the invention is applied.

The first sheet presser 11 is adapted to support, in an initial step of an operation for shaping by pressing, drawing or the like, shown schematically by way of example in FIG. 2, a metal sheet 12 to be shaped.

The sheet 12 is supported so as to lie above a first lower die part 13, which is rigidly coupled to the base 14 of a press 15.

The first sheet presser 11 cooperates with a second sheet presser 16, which is rigidly coupled to a second die part 17 associated with an upper ram 18 of the press, in locking a perimetric portion 19 of the metal sheet 12 during the shaping operation.

The actuators 20 are part of a circuit 21 for regenerating and supplying the working fluid.

Figure 3:
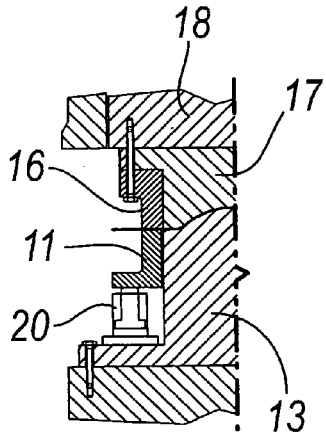
FIGS. 3 to 5 are views of successive steps of the operation of a press to which an apparatus according to the invention is applied.
Figure 4:
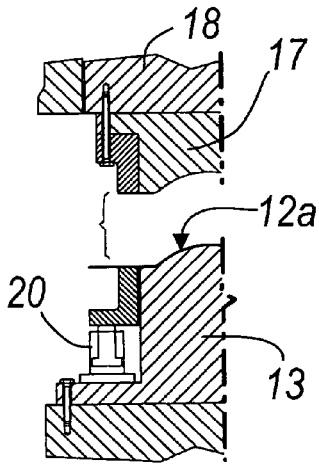
Figure 5:
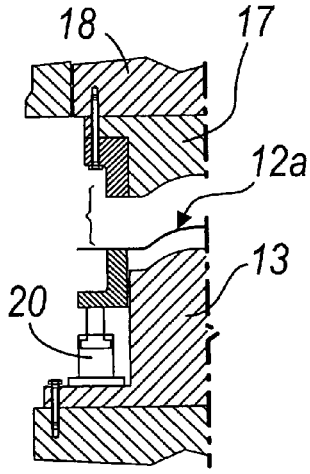

The circuit 21 is provided with means for the delayed return of the actuators 20 during the opening of the press 15 so as to protect the integrity of the shaped sheet, which is designated by the reference numeral 12*a* in FIGS. 3 to 5.

The actuators 20 are hydraulic cylinders and the working fluid is a hydraulic liquid such as oil or equivalent.

The apparatus 10 according to the invention, therefore, does not use gas cylinder actuators, like known types of apparatus, with all the consequent advantages.

Since oil is substantially incompressible, it in fact does not expand when the pressure of the upper ram of the press is no longer provided, allowing to eliminate all the deformations due to warping or inflection that the above cited "spring-back" effect of gas cylinder actuators may cause on the freshly shaped sheets 12*a*.

The means for the delayed return of the actuators 20 are therefore constituted by a one-way valve 22, which is arranged on a discharge duct 23 of each piston 20.

In another embodiment of the invention, not shown for the sake of simplicity, the one-way valve 22 is provided on the outside of the end face of the actuator 20, for example on a discharge branch 23*a* in output from the actuator 20.

An electric valve 24 cooperates with the one-way discharge valve 22 and is interposed between an additional one-way loading valve 27, which is arranged inside the loading duct 26 of each cylinder 20, and a pump 25 for feeding the circuit.

The one-way loading valve 27, in a manner similar to what has been described for the discharge valve 22, also can be installed, in a further embodiment of the invention which is not shown, externally with respect to the actuator 20, for example on the loading branch 26*a*.

The electric valve 24 is time-controlled so as to delay the sending of pressurized oil from the pump 25 to the loading duct 26, thus delaying the consequent rise of the first sheet presser 11 for a period sufficient to avoid warping, inflections and other similar unwanted deformations of the contoured sheet of metal 12*a*.

The electric valve 24 allows to start the rise of the first sheet presser 11 and the separation of the shaped sheet 12*a* from the lower die part 13 at a precise presettable time, without said time being anticipated uncontrollably as often occurs in known apparatuses provided with gas cylinder actuators.

The one-way valve 22 and the electric valve 24 therefore allow the precise and repeatable stopping of the actuators 20, both when the pistons thereof reach the end of their stroke, in the maximum shortening configuration of said actuators, and in an intermediate partial-stroke configuration.

The circuit 21 comprises, between an oil reservoir 28, from which the pump 25 draws, and the one-way discharge valve 22, a valve 29 for adjusting the contrast force applied by the actuators 20 during the descent of the ram 18 of the press 15.

A safety valve 30 is associated with the valve 29 for adjusting the contrast force and in case of overpressure on the adjustment valve 29 enables the discharge of the oil in the reservoir 28.

Between the electric valve 24 and the one-way loading valve 27, the circuit 21 has a flow regulator 31 in order to determine the rate of rise of the first presser 11.

While the electric valve 24 allows to predetermine the moment when the extension of the actuator 20 starts, the flow regulator 21 allows to adjust the rise rate.

A cooling device 33 for the oil pressurized by the pump 25 is provided between the pump 25 and the electric valve 24.

The cooling device 33, which uses air or is constituted by another equivalent heat exchanger, ensures the oil sent by the pump 25 to the hydraulic actuators 20 is never overheated.

The circuit 21 conveniently has a safety valve 34 on the delivery branch of the pump 25.

In the embodiment of the apparatus 10 according to the invention described here by way of non-limiting example, the electric valve 24 is of the type with two positions and three couplings.

A first position A of the electric valve 24 allows to send the pressurized oil that arrives from the pump 25 toward the actuators 20.

A second position B is adapted to redirect the oil toward the reservoir 28.

In the reservoir 28, the oil is free to expel the air that has entered it, by recirculating in the circuit 21.

The reservoir 28 further has a filter 28*a*, which protects the intake of the pump 25 against any impurities.

Between the valve 29 for adjusting the contrast force and the reservoir 28, and between the flow regulator 31 and the actuators 20, the circuit 21 is provided with flexible hoses 35, which are adapted to facilitate the installation of the actuators 20 proximate to the lower die part 13.

Such an apparatus 10 can be installed in hydraulic presses with the possibility of parking at the bottom dead center and likewise in mechanical presses which act without stopping at the bottom dead center, where the expression "bottom dead center" is used to designate the stroke limit of the upper die part closed onto the lower die part.

In practice it has been found that the invention thus described solves the problems noted in known types of apparatus for locking a metal sheet suitable to be shaped in a press.

In particular, the present invention provides an apparatus which is capable of maintaining the retention of the lower sheet presser when the press stops applying its thrust and the upper die part is lifted.

Moreover, the present invention provides an apparatus which is simpler and cheaper than known apparatuses and can be applied easily to presses which are already known and in operation.

Further, the present invention provides an apparatus in which the temperature of the fluid used therein can be controlled easily.

Further, the present invention provides an apparatus in which the contrast force of the fluid-operated actuators on the lower sheet presser is adjustable, and likewise the time when the rise of the lower sheet presser begins and its rate of rise can be preset.

Moreover, the present invention provides an apparatus for locking a sheet of metal suitable to be shaped in a press which can be manufactured cheaply with known systems and technologies.

The invention thus conceived is susceptible of numerous modifications and variations, all of which are within the scope of the appended claims; all the details may further be replaced with other technically equivalent elements.

In practice, the materials employed, so long as they are compatible with the specific use, as well as the dimensions, may be any according to requirements and to the state of the art.

The disclosures in Italian Patent Application No. PD2005A000138 from which this application claims priority are incorporated herein by reference.

What is claimed is:

1. An apparatus for locking a sheet of metal suitable to be shaped in a press having a first lower die part and a second die part, a base upper ram, comprising: a first sheet presser; a second presser; a circuit for regenerating and supplying working fluid; at least one fluid-operated actuator for actuating in vertical translational motion said first sheet presser, which is adapted to support, in an initial step of an operation for shaping by pressing or drawing, a sheet of metal to be shaped, the metal sheet being arranged above the press first lower die part, which is rigidly coupled to the base of the press, said first presser being adapted to cooperate with the second presser, which is rigidly coupled to the press second die part associated with the upper ram of the press, in locking a perimetric portion of the sheet of metal during said shaping operation, said at least one actuator being part of the circuit for regenerating and supplying the working fluid, that is provided with return means for delayed return of the at least one actuator, upon opening of the press, in order to protect integrity of the shaped sheet, said at least one actuator being a hydraulic cylinder and said working fluid being a hydraulic liquid.

2. The apparatus of claim 1, wherein said at least one actuator comprises a discharge duct, a discharge branch, a loading duct with an additional one-way loading valve, a loading branch, said return means being constituted by: a one-way valve arranged on said discharge duct or on said discharge branch; by an electric valve, which is interposed between the additional one-way loading valve, which is arranged in said loading duct or on said loading branch; and by a circuit supply pump, said electric valve being time-controlled so as to delay sending of pressurized oil from said pump to said loading duct and delay consequent rise of the first sheet presser for a time interval which avoids warping, inflections and any other unwanted deformation of a shaped metal sheet.

3. The apparatus of claim 2, wherein said electric valve is time-controlled so as to be synchronized with a cycle of the press with which said electric valve is associated.

4. The apparatus of claim 2, wherein said pump is provided with an oil reservoir from which said pump draws, said circuit comprising, located between the oil reservoir and said one-way discharge valve, an adjustment valve for adjusting a contrast force applied by the at least one actuator.

5. The apparatus of claim 4, further comprising a safety valve associated with said contrast force adjustment valve.

6. The apparatus of claim 4, wherein said circuit has a flow regulator for adjusting a rise rate of the first presser located between said electric valve and said one-way loading valve.

7. The apparatus of claim 4, comprising a cooling device for oil circulated by the pump that is located between said pump and said electric valve.

8. The apparatus of claim 7, wherein the circuit has a safety valve located on a delivery branch of the pump.

9. The apparatus of claim 8, wherein said electric valve comprises two positions and three couplings, of which, a first position for sending pressurized oil that arrives from the pump toward the at least one actuator, a second position for redirecting oil toward the reservoir.

10. The apparatus of claim 7, wherein said circuit has flexible hoses which facilitate installation of the at least one actuator proximate to the lower die part located between said contrast force adjustment valve and the reservoir, and between the flow regulator and said at least one actuator.

* * * * *